US008966768B2

(12) United States Patent
Onion

(10) Patent No.: US 8,966,768 B2
(45) Date of Patent: Mar. 3, 2015

(54) BALL BEARING ASSEMBLY FOR FOLDING KNIFE OR TOOL

(75) Inventor: Kenneth J. Onion, Kaneoho, HI (US)

(73) Assignee: GB II Corporation, Tualatin, OR (US)

( * ) Notice: Subject to any disclaimer, the term of this patent is extended or adjusted under 35 U.S.C. 154(b) by 360 days.

(21) Appl. No.: 13/414,562

(22) Filed: Mar. 7, 2012

(65) Prior Publication Data

US 2012/0234142 A1 Sep. 20, 2012

Related U.S. Application Data

(60) Provisional application No. 61/450,071, filed on Mar. 7, 2011.

(51) Int. Cl.

| | |
|---|---|
| ***B26B 1/04*** | (2006.01) |
| ***B26B 1/02*** | (2006.01) |
| ***B25G 3/38*** | (2006.01) |

(52) U.S. Cl.

CPC . *B26B 1/02* (2013.01); *B26B 1/044* (2013.01); *B25G 3/38* (2013.01)

USPC ..... 30/160; 30/155; 30/161

(58) Field of Classification Search

CPC ..... B25G 3/38; B26B 1/02; B26B 1/044; B26B 13/28; B25B 7/06

See application file for complete search history.

(56) References Cited

U.S. PATENT DOCUMENTS

| | | | | | |
|---|---|---|---|---|---|
| 672,050 | A * | 4/1901 | Williamson | ..... | 30/267 |
| 951,539 | A * | 3/1910 | Mickleson | ..... | 30/267 |
| 1,885,754 | A * | 11/1932 | Nachtigall | ..... | 30/267 |
| 2,032,281 | A * | 2/1936 | Haywood | ..... | 30/267 |
| 3,170,237 | A * | 2/1965 | Weidauer | ..... | 30/268 |
| 5,628,116 | A * | 5/1997 | Kohno | ..... | 30/267 |
| 5,694,694 | A * | 12/1997 | Roskam | ..... | 30/254 |
| 5,699,615 | A * | 12/1997 | Chen | ..... | 30/160 |
| 5,802,722 | A | 9/1998 | Maxey et al. | | |
| 5,815,927 | A | 10/1998 | Collins | | |
| 6,145,202 | A | 11/2000 | Onion | | |
| 6,308,420 | B1 | 10/2001 | Moser | | |
| 6,651,344 | B2 | 11/2003 | Cheng | | |
| 6,834,432 | B1 | 12/2004 | Taylor | | |
| 7,051,441 | B2 | 5/2006 | Carter, III | | |
| 7,086,157 | B2 | 8/2006 | Vallotton | | |
| 7,140,110 | B2 | 11/2006 | Lake | | |
| 7,146,736 | B1 | 12/2006 | Collins | | |
| 7,284,329 | B1 | 10/2007 | King | | |
| 7,293,360 | B2 * | 11/2007 | Steigerwalt et al. | ..... | 30/160 |
| 7,313,866 | B2 * | 1/2008 | Linn et al. | ..... | 30/159 |
| 7,340,838 | B2 | 3/2008 | Onion | | |
| 7,437,822 | B2 * | 10/2008 | Flagg et al. | ..... | 30/161 |
| 7,905,023 | B2 * | 3/2011 | Westerfield | ..... | 30/161 |
| 7,918,028 | B2 | 4/2011 | Steigerwalt et al. | | |

(Continued)

*Primary Examiner* — Hwei C Payer

(74) *Attorney, Agent, or Firm* — Klarquist Sparkman, LLP

(57) ABSTRACT

Disclosed herein is a folding tool having a handle, a tool element and a ball bearing assembly. In some embodiments of the present disclosure, the handle of the folding tool includes a first, second side panel and a first, second side panel liner wherein the ball bearing assembly is positioned between the first side panel liner and the second side panel liner. The ball bearing assembly includes a first bearing race and a second bearing race each race having a ball housing. A plurality of balls reside partially within each ball housing and are positioned to contact an adjacent side surface of the tang of the tool element thereby allowing the plurality of balls to roll along opposing sides of the tang as the tool element is pivoted from the open position to the closed position. In some embodiments, the tool element is a knife blade.

21 Claims, 4 Drawing Sheets

(56) References Cited

U.S. PATENT DOCUMENTS

| | | | | |
|---|---|---|---|---|
| 8,261,633 | B2 * | 9/2012 | Maxey | 76/119 |
| 8,561,304 | B2 * | 10/2013 | Caswell | 30/157 |
| 2004/0020058 | A1 | 2/2004 | Vallotton | |
| 2004/0244205 | A1 | 12/2004 | Linn et al. | |
| 2005/0223563 | A1 | 10/2005 | VanHoy et al. | |
| 2006/0021230 | A1 * | 2/2006 | Mikami | 30/194 |
| 2006/0059694 | A1 * | 3/2006 | Carter | 30/159 |
| 2007/0068000 | A1 * | 3/2007 | Onion | 30/160 |
| 2007/0234574 | A1 * | 10/2007 | Constantine et al. | 30/254 |
| 2008/0201953 | A1 * | 8/2008 | Bremer et al. | 30/1 |
| 2009/0271989 | A1 | 11/2009 | Vanhoy | |
| 2013/0047439 | A1 * | 2/2013 | Hawk et al. | 30/160 |

* cited by examiner

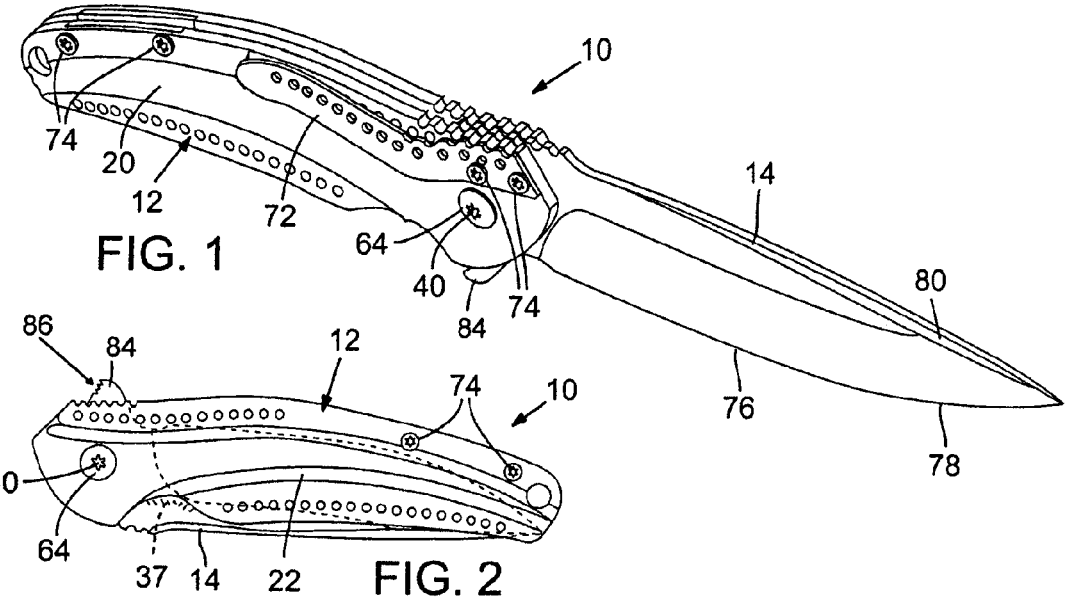
FIG. 1
FIG. 2
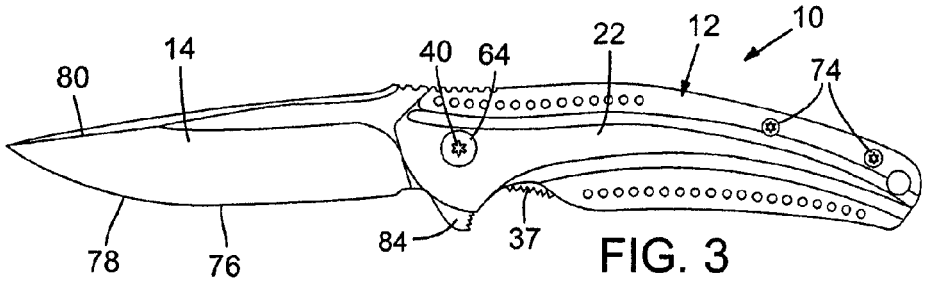
FIG. 3
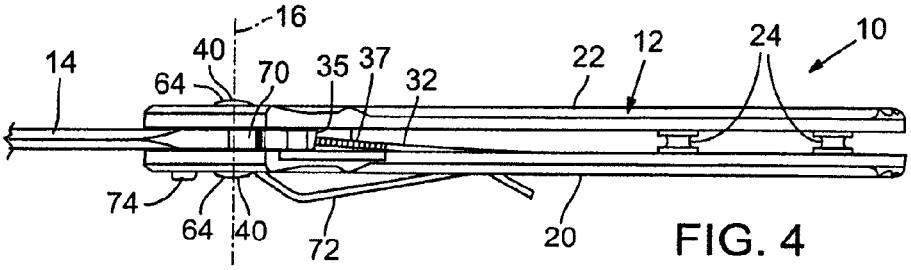
FIG. 4

BALL BEARING ASSEMBLY FOR FOLDING KNIFE OR TOOL

CROSS-REFERENCE TO RELATED APPLICATION

The present application claims the benefit of U.S. Provisional Application No. 61/450,071 filed Mar. 7, 2011, which is incorporated herein by reference.

FIELD

The present disclosure concerns embodiments of a ball bearing assembly for use in a tool having a pivotable tool element, such as a folding knife having a pivotable knife blade.

BACKGROUND

A folding knife connects the blade to the handle through a pivot, allowing the blade to fold into the handle. Folding knives are attractive to many users as compared to a fixed blade knife because they are lightweight, versatile and easily carried. Folding knives utilize a variety of folding mechanisms. However, most designs and systems used for folding have proven to be expensive, unsafe, and mechanically unreliable. For example, prior ball bearing systems for folding knives utilize balls disposed in annular races machined directly into the side panels of the handle. Unfortunately, it is difficult to manufacture the side panels of the handle with a high degree of planarity. As such, the balls are susceptible to binding after repeated use. Moreover, if the side panels are made of a relatively softer metal than the balls, the bearing races wear relatively quickly.

SUMMARY

Disclosed herein is a folding tool, such as a folding knife which includes a ball bearing assembly which addresses the problems of the prior art because the races are manufactured with a high degree of planarity and precision. When mounted on pivots, the races are maintained in precise parallel alignment with respect to each other. The blade which is mounted on the shaft of the races therefore can be maintained in precise parallel alignment with the races to ensure there is even contact between the blade and the balls of both bearings. In addition, the balls and the races desirably can be made of materials with similar hardness to reduce wear. For example, the balls and the races can be made of hardened steel, while the side panels and liners of the handle can be made of a relatively softer material, such as aluminum.

In one representative embodiment of the present disclosure, a folding tool comprises a handle, a tool element and a ball bearing assembly. In some embodiments, the handle portion includes a first side panel with a first side panel inner surface and a second side panel with a second side panel inner surface. In some embodiments, a tool element is pivotably connected to the handle portion and comprises a tang; the tool element being pivotable relative to the handle portion between a closed position and an open position. In some embodiments, the bearing assembly is disposed in the handle portion and comprises a first bearing race and a second bearing race, wherein each race comprises a ball housing in which a plurality of balls partially reside therein. In some embodiments, the plurality of balls of each housing are positioned to contact an adjacent side surface of the tang thereby allowing the plurality of balls to roll along opposing sides of the tang as the tool element is pivoted from the open position to the closed position or the closed position to the open position.

In some representative embodiments, the folding tool further comprises a first side panel liner and a second side panel liner wherein the first side panel liner is positioned adjacent to the first side panel inner surface and the second side panel liner is positioned adjacent to the second side panel inner surface.

In some representative embodiments, the first side panel inner surface includes a recessed portion and the second side panel inner surface includes a recessed portion for receiving the first side panel liner and the second side panel liner, respectively.

In some representative embodiments, the bearing assembly comprises a shaft extending through the tang and opposite end portions on which the bearing races are mounted.

In some representative embodiments, the first race and second race each further include a flange extending radially outwardly from an inner end of the ball housing and a head portion extending axially from an outer end of the ball housing.

In some representative embodiments, the flange has a diameter greater than the opening in the first side panel liner and the second side panel liner.

In some representative embodiments, the bearing assembly further comprises a first screw for securing the first race to the first side panel and a second screw for securing the second race to the second side panel.

In some representative embodiments, each ball housing comprises a groove for receiving the plurality of balls. For example, each groove has a surface which corresponds to the curvature of the ball of the plurality of balls.

In some representative embodiments, the tool element is a knife blade.

In some representative embodiments, the ball housing comprises a first material and the first side panel and second side panel comprise a second material, the first material being harder than the second material. For example, the ball housings are made of steel and the first side panel and the second side panel are made of aluminum.

In some representative embodiments, the plurality of balls and the ball housing are made of the same material.

In some representative embodiments, the tang comprises an oversized tang portion that extends outwardly through an upper edge of the handle portion when the tool element is in the closed position.

In some representative embodiments, the folding tool further comprises a biasing element configured to apply an opening force to the blade.

In some representative embodiments, a method of operating a folding tool, such as a folding knife is disclosed. In some representative embodiments, the method comprises providing a folding knife comprising: a handle portion; a blade pivotably connected to the handle portion and including a tang; and a ball bearing assembly disposed in the handle portion and comprising a first bearing race and a second bearing race each race having a ball housing in which a plurality of balls partially reside therein. The method also comprises when the blade is in a closed position, applying an opening force to the blade to displace the blade from the closed position, thereby allowing the plurality of balls within each ball housing to roll along opposing sides of the tang of the blade as the blade pivots from the closed position to an open position.

In some representative embodiments, a folding knife is provided. In some representative embodiments, the folding knife comprises a handle, a blade and a ball bearing assembly.

In some representative embodiments, the folding knife comprises a handle portion including a first side panel with a first side panel inner surface and a second side panel with a second side panel inner surface and a first side panel liner and a second side panel liner wherein the first side panel liner is positioned adjacent to the first side panel inner surface and the second side panel liner is positioned adjacent to the second side panel inner surface. In some representative embodiments, the blade is pivotably connected to the handle portion and comprises a tang, a bottom surface including a sharpened edge, and an upper surface opposite the bottom surface, the blade being pivotable relative to the handle portion between a closed position and an open position wherein the sharpened edge is exposed for use. In some representative embodiments, the bearing assembly is positioned between the first side panel and the second side panel, wherein the tang of the blade, the first side panel liner and the second side panel liner each include an opening for mounting the bearing assembly and the bearing assembly comprises a first bearing race and a second bearing race, wherein each bearing race comprises a ball housing; and a first screw for securing the first race of the first side panel and a second screw for securing the second race of the second side panel; and a plurality of balls residing partially within each ball housing, wherein the plurality of balls are positioned to contact an adjacent side surface of the tang thereby allowing the plurality of balls to roll along opposing sides of the tang as the blade is pivoted from the open position to the closed position or the closed position to the open position.

The foregoing and other features and advantages will become more apparent from the following detailed description of several embodiments, which proceeds with reference to the accompanying figures.

BRIEF DESCRIPTION OF THE DRAWINGS

FIG. 1 is a perspective view of a folding knife, according to one embodiment, showing the blade of the knife in its extended position.

FIG. 2 is a side view of the folding knife of FIG. 1 in a collapsed, folded position.

FIG. 3 is a side view of the folding knife of FIG. 1 showing the blade of the knife in its extended position.

FIG. 4 is a plan view of the bottom of the folding knife shown in FIG. 3.

DETAILED DESCRIPTION

Figures 5, 6:
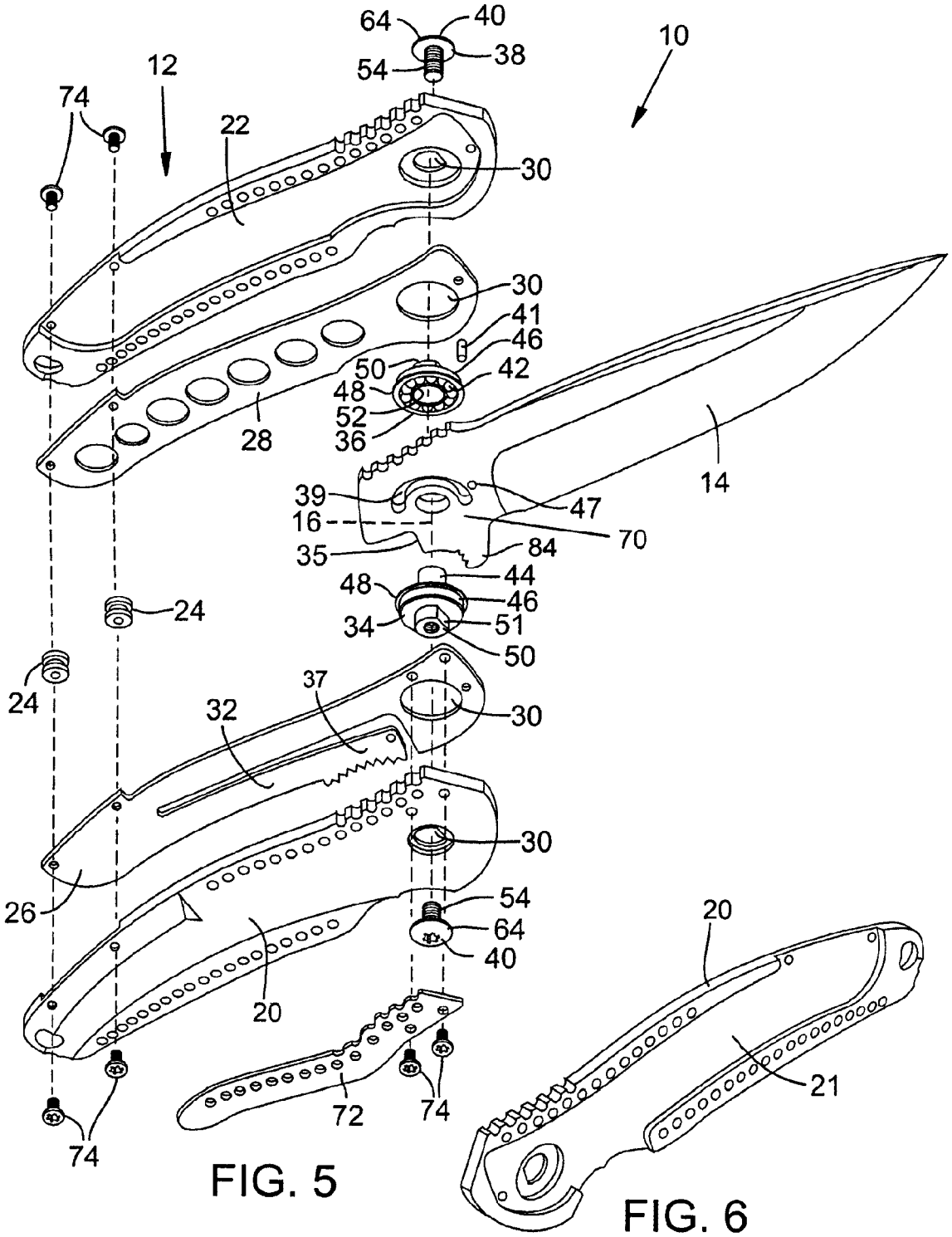
FIG. 5 is an exploded, perspective view of the folding knife of FIG. 1.
FIG. 6 is a perspective view of a side panel of the handle.

Referring first to FIGS. 1 and 2, there is shown a folding knife 10, according to one embodiment, comprising a handle 12 and a knife blade 14. The blade 14 is pivotably coupled to the handle 12 for pivoting movement about a pivot axis 16 (shown in FIGS. 4 and 5) between an open position (shown in FIGS. 1 and 3) and a closed position wherein the blade is at least partially stored inside the handle (shown in FIGS. 2 and 7). The blade 14 in the illustrated embodiment is coupled to the handle 12 via a bearing assembly 18 (FIGS. 5 and 9-13), which is described in greater detail below. The blade 14 has a "bottom" surface 76 that includes a sharpened edge 78 (referred to as the sharpened side or edge of the blade) and an "upper" surface 80 (referred to as the non-sharpened side or edge of the blade). The knife 10 can be provided with a clip 72 secured to the handle portion 12 so that the knife can be clipped onto a belt, a pocket, etc.

Figure 7:
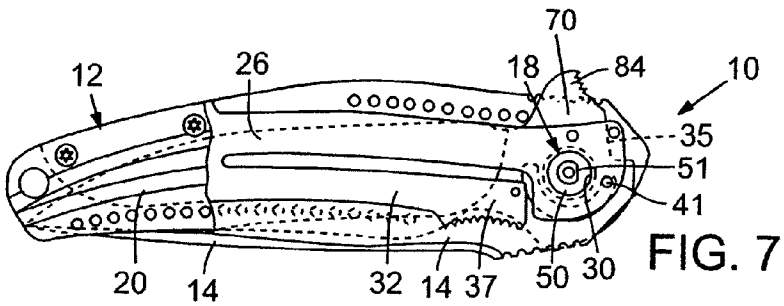
FIG. 7 is a side elevation view of the folding knife of FIG. 1 in the collapsed, folded position with one of the side panels removed.
Figure 8:
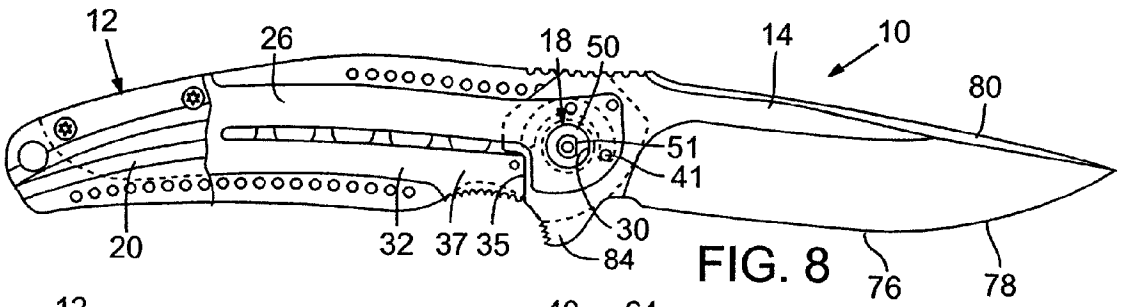
FIG. 8 is a side elevation view of the folding knife of FIG. 1 in the extended, open position with one of the side panels removed.

As best shown in FIGS. 4 and 5, the handle 12 can comprise first and second side panels 20, 22 (also referred to as right and left side portions of the handle) that can be coupled to each other by one or more spacers 24. The handle 12 can also include first and second liners 26, 28 (FIG. 5) positioned adjacent inner surfaces of side panels 20, 22, respectively. The side panels 20, 22 can be formed with recessed portions on their inner surfaces (such as recess 21 on side panel 20 shown in FIG. 6) that are sized to receive the first and second liners 26, 28, respectively. As best shown in FIG. 5, each liner 26, 28 is formed with a respective opening 30 for mounting the bearing assembly 18, as further described below. As best shown in FIG. 8, the liner 26 can be formed with a locking arm, or leaf spring, 32 for holding the blade 14 in its open position, as known in the art. The locking arm 32 is normally biased into a locking position wherein the free end of the locking arm 32 engages a rear edge portion 35 of the tang 70 of the blade so as to resist inadvertent closure of the blade. The locking arm 32 can be released from its locked position by moving the free end of the locking arm laterally away from the rear edge 35 of the handle toward the side panel 20 allowing the blade 14 to be folded into the handle 12 as shown in FIG. 7. As shown in FIG. 5, a pin 41 can be positioned a slot 39 in the blade 14 to control the swing of the blade 14 and a detent 47 can be provided in the blade 14 so in operation the detent 47 assists in retaining the blade 14 in a closed position.

In certain embodiments, the locking arm is provided with a tab 37 (as shown in FIG. 5). For example, the tab can include a raised head, which is used to press against the back end of the tang 70 of the blade 14 when the blade 14 is being extended from the handle. The tab 37 can be released/unlocked by applying manual pressure to the tab 37 causing it to be released and allowing the blade 14 to be folded into the handle 12 (shown in FIG. 7).

In certain embodiments, the knife 10 can be an assisted-opening knife or an automatic knife, and therefore includes a biasing element 86, such as a spring operatively connected to the blade, which applies an opening force to the blade. The biasing element of an assisted-opening knife is operable to apply an opening force to the blade after manual pressure is applied to the blade to pivot the blade from the closed position 20 to an intermediate position between the closed and open positions. When the blade reaches the intermediate position, the force exerted by the biasing element causes the blade to further pivot from the intermediate position to the open position. Spring configurations for assisted-opening knives are disclosed in U.S. Pat. No. 6,834,432 and U.S. Pat. No. 6,145,202, which are incorporated herein by reference.

As best shown in FIG. 2, the tang 70 can include an oversized tang portion 84 (sometimes referred to as a "flipper") that extends outwardly from the upper longitudinal edge of the handle portion 12 when the blade is in the closed position. The oversized tang portion can be used to open the blade. For example, the blade can be opened by applying sufficient manual pressure to the oversized tang portion (in the general direction of arrow 86 in FIG. 2), such as by pressing on the oversized tang portion with a finger, to pivot the blade to the intermediate position, at which point the biasing element can further pivot the blade to the open position.

In embodiments where the knife comprises an automatic knife, the knife can include a biasing element, such as a spring, that applies an opening force to the blade that is strong enough to cause the blade to pivot from the closed position to the open position. The automatic knife can comprise a blade-locking element (such as a cross-bolt) that retains the blade in the closed position against the opening force of the biasing element. When the blade-locking element is activated by a user to release the blade, the biasing element causes the blade to open.

Figure 9:
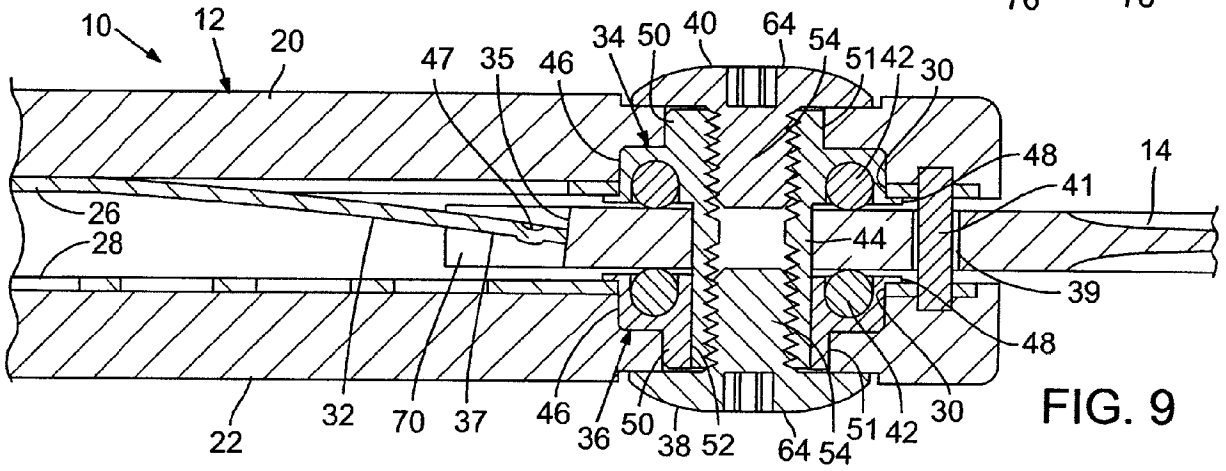
FIG. 9 is a partial cross-sectional view of the folding knife shown in FIG. 8.

FIG. 8 is a side elevation view of the folding knife of FIG. 1 in the extended, open position with one of the side panels removed. FIG. 9 is a partial cross-sectional view of the bottom of the folding knife shown in FIG. 8 illustrating the bearing assembly 18 including first and second bearing races 34, 36, respectively.

Figure 10:
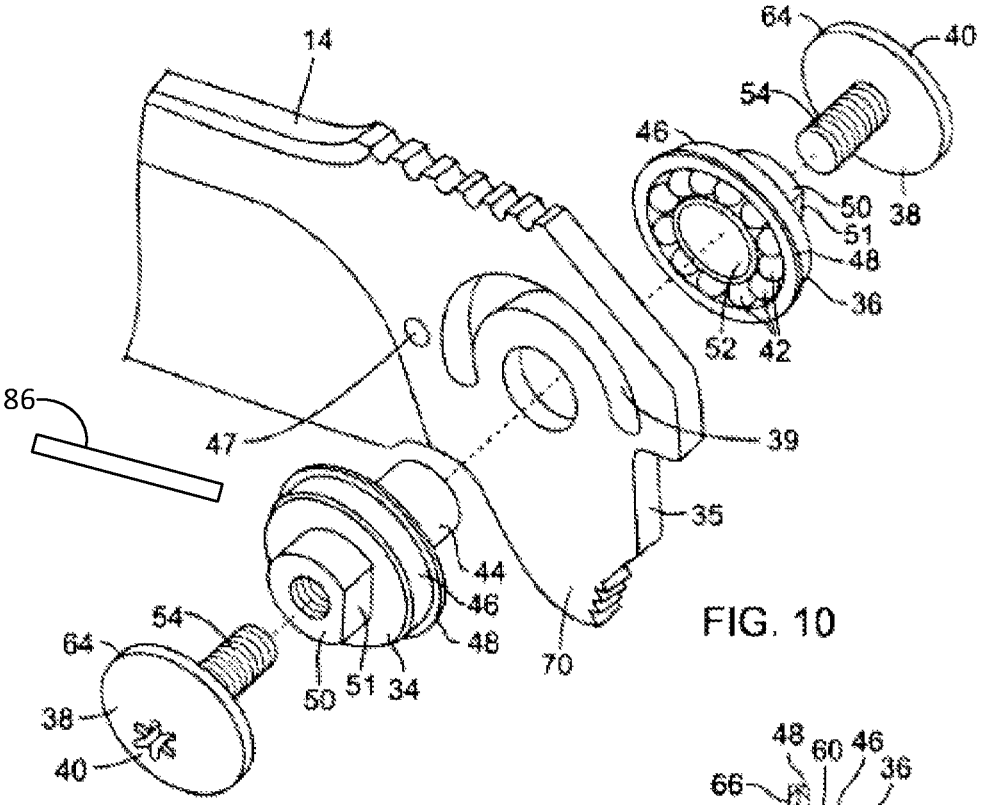
FIG. 10 is an exploded, perspective view of a ball bearing assembly.

FIG. 10 is an exploded view of the bearing assembly 18. The bearing assembly 18 in the illustrated configuration includes first and second bearing races 34, 36, respectively, and first and second pivot elements 38, 40, respectively (also referred to as pivot screws). Each race 34, 36 houses a plurality of balls 42. The first 20 race 34 includes a shaft 44 that extends through an opening in the tang 70 of the blade 14. Although the shaft 44 is shown as an integral component of the first race 34, it can be a separate component that is secured to the race 34. For example, the shaft 44 can be press fit into a central opening in the race 34. Each race 34, 36 in the illustrated embodiment includes a ball housing 46, an annular lip or flange 48 extending radially 25 outwardly from the inner end of the ball housing 46, and a head portion 50 extending axially from the outer end of the ball housing 46. The head portion 50 of each race includes a flat surface 51 corresponding with a flat surface in the opening 30 of an adjacent side panel 20, 22 (as shown in FIG. 5).

Referring to FIG. 9, when the knife is assembled, the ball housing 46 of each race is disposed in a respective opening 30 of a corresponding liner 26, 28, and the annular lip 48, which has a diameter greater than opening 30, bears against the inner surface of the corresponding liner 26, 28. The head portion 50 of each race extends into a corresponding opening of an adjacent side panel 20, 22 of the handle. The shaft 44 extends from the inner end of the ball housing 46 of race 34 through an opening in the blade tang, and into a central opening 52 of race 36. The races 34, 36 can be held in place by pivot elements 38, 40. For example, the shaft 44 can have a threaded bore, and each pivot element 38, 40 can have a respective head portion 64 and a threaded pin 54 extending therefrom. When the knife is assembled, the pins 54 are tightened into opposite ends of the threaded bore of the shaft 44, and the head portions 64 can bear against the outer surfaces of the side panels 20, 22. The knife handle 12 is assembled by securing the side panel 20 to side panel 22 by a plurality of screws 74. As shown in FIG. 5, two screws 74 are threaded through openings in side panel 20, 22 and then through corresponding openings in liners 26, 28 into spacers 24. The clip can comprise an elongated body having one or more openings for receiving one or more fasteners can be mounted onto the outer surface of the side panel 20 or 22 of the handle portion 12 by positioning the one or more fasteners (such as a pair of screws 74 as shown in FIG. 5) through the one or more openings in the body of the clip which align with corresponding openings in the outer surface of side panel 20, 22. Other retaining mechanisms in lieu of or in addition to a screw can be used to secure the clip 72 to the handle portion 12 of the knife 10, including, but not limited to, a ball and detent retaining mechanism disclosed in U.S. patent application Ser. No. 12/429,051 which is hereby incorporated by reference.

Figure 11:
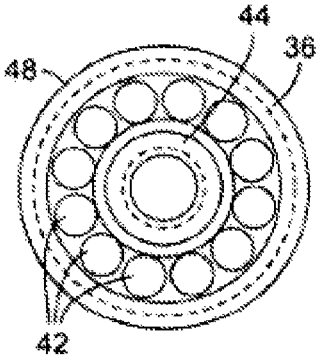
FIG. 11 is a side view of the inner face of one of the races of the bearing assembly with a shaft inserted in the central opening of the race.
Figure 12:
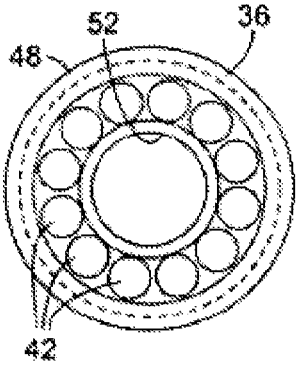
FIG. 12 is a side view of the inner face of one of the races of the bearing assembly.
Figure 13:
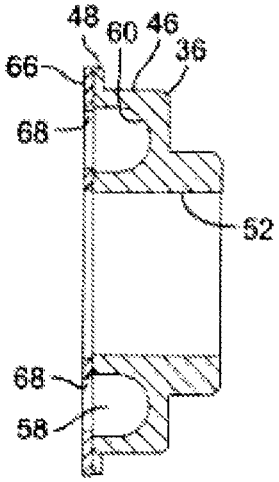
FIG. 13 is a cross-sectional view of one of the races of the bearing assembly.

As shown in FIGS. 11-13, the balls 42 of each race are disposed in an annular slot or groove 58 formed in each ball housing 46. The groove 58 can have a radiused 25 surface 60 that corresponds to the curvature of the balls 42. The balls 42 reside partially outside of their respective ball housing and are positioned to contact an adjacent side surface of the blade tang 70. The balls 42 therefore can roll along the opposing sides of the blade tang 70 as the blade is pivoted from the open position to the closed position, and vice versa, to minimize friction on the sides of the blade. The opposing sides of the blade contacted by the balls are those sides that extend from the "upper" edge 80 to the lower edge 76 of the blade perpendicular to the pivot axis 16. As can be appreciated, the opening force or inertia required to begin pivoting the blade from its closed position can be significantly reduced due to reduced friction of the blade. Even without a biasing element that applies an opening force to the blade, it is possible to fully open the blade from the closed position by applying manual pressure to the oversized tang portion 84. For example, the knife can be opened by placing the knife in the hand with the non-sharpening edge of the blade facing away from the palm, and then exerting 10 manual pressure on the oversized tang portion 84 with the forefinger.

In certain embodiments, the balls 42 are not disposed in annular races machined directly into the first side panel 20 and the second side panel 22 of the handle 12.

A significant advantage of the bearing assembly 18 is that the dimensions and tolerances of the races 34, 36 can be tightly controlled to ensure that there is even and consistent contact between the balls 42 and the sides of the blade. Prior ball bearing systems for folding knives utilize balls disposed in annular races machined directly into the side panels of the handle. Unfortunately, it is difficult to manufacture the side panels of the handle with a high degree of planarity. As such, the balls can be susceptible to binding after repeated use. Moreover, if the side panels are made of a relatively softer metal than the balls, the bearing races can wear relatively quickly. In contrast, the bearing assembly 18 addresses the problems of the prior art because the races 34, 36 can be manufactured with a high degree of planarity and precision. When mounted on pivots 38, 40, the races 34, 36 can be maintained in precise parallel alignment with respect to each other. The blade 14, which is mounted on shaft 44 of the races, therefore can be maintained in precise parallel alignment with the races to ensure there is even contact between the blade and the balls of both bearings. In addition, the balls and the races desirably can be made of materials with similar hardness to reduce wear. For example, the balls and the races can be made of hardened steel, while the side panels and liners of the handle can be made of a relatively softer material, such as aluminum. As can be appreciated, the choice of material for the side panels and liners of the handle does not affect the operation and durability of the bearing assembly because the balls are contained within respective races of similar hardness.

In particular embodiments, the knife 10 can be provided with different sized bearings. In other words, one side of the handle can be provided with a relatively larger race and balls compared to the other side of the handle.

In certain embodiments, such as depicted in FIG. 13, the annular grooves 58 in races 34, 36 can be covered by a cover 66 to help seal the races and prevent the ingress of particulate matter into the grooves 58. The cover 66 can be formed with a plurality of openings 68, each aligned with a respective ball 42 to allow the balls to contact the sides of the blade through the cover. The cover 66 can be made of a low-friction, polymeric material, such as Mylar™.

The bearing assembly 18 can be used in devices other than folding knives. In particular, the bearing assembly can be adapted for use in various types of hand tools that have a tool element that is pivotably connected to a handle. In one implementation, for example, a hand tool can have a construction similar to that of folding knife 10, except that the blade 14 is replaced with a different type of tool element, such as a file, a screwdriver blade, a saw blade, a bottle opener, etc. In another implementation, the bearing assembly 18 can be adapted to form the pivot of a pair of scissors.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A folding tool, comprising:

a handle portion including a first side panel with a first side panel inner surface and a second side panel with a second side panel inner surface;

a tool element pivotably connected to the handle portion and comprising a tang, and the tool element being pivotable relative to the handle portion between a closed position and an open position; and a bearing assembly disposed in the handle portion and comprising a first bearing race and a second bearing race, wherein each race comprises a ball housing in which a plurality of balls partially reside therein, wherein the plurality of balls of each housing are positioned to contact an adjacent side surface of the tang thereby allowing the plurality of balls to roll along opposing sides of the tang as the tool element is pivoted from the open position to the closed position or the closed position to the open position, wherein the first bearing race comprises a shaft fixedly secured to the ball housing of the first bearing race, the shaft extending through an opening in the tang and into an opening in the second bearing race.

2. The folding tool of claim 1, further comprising a first side panel liner and a second side panel liner, wherein the first side panel liner is positioned adjacent to the first side panel inner surface, and the second side panel liner is positioned adjacent to the second side panel inner surface.

3. The folding tool of claim 2, wherein the first side panel inner surface includes a recessed portion, and the second side panel inner surface includes a recessed portion for receiving the first side panel liner and the second side panel liner, respectively.

4. The folding tool of claim 1, wherein each ball housing comprises a groove for receiving the plurality of balls.

5. The folding tool of claim 4, wherein each groove has a surface which corresponds to the curvature of the ball of the plurality of balls.

6. The folding tool of claim 1, wherein the tool element is a knife blade.

7. The folding tool of claim 1, wherein the ball housing comprises a first material, and the first side panel and the second side panel comprise a second material, the first material being harder than the second material.

8. The folding tool of claim 7, wherein the ball housings are made of steel, and the first side panel and the second side panel are made of aluminum.

9. The folding tool of claim 7, wherein the plurality of balls and the ball housing are made of the same material.

10. The folding tool of claim 1, wherein the tang comprises an oversized tang portion that extends outwardly through an upper edge of the handle portion when the tool element is in the closed position.

11. The folding tool of claim 10, further comprising a biasing element configured to apply an opening force to the tool element.

12. The folding tool of claim 1, wherein the shaft and the ball housing of the first bearing race comprise an integral, one-piece unitary construction.

13. A folding tool, comprising:

a handle portion including a first side panel with a first side panel inner surface, a second side panel with a second side panel inner surface, a first side panel liner, and a second side panel liner, wherein the first side panel liner is positioned adjacent to the first side panel inner surface, and the second side panel liner is positioned adjacent to the second side panel inner surface;

a tool element pivotably connected to the handle portion and comprising a tang, and the tool element being pivotable relative to the handle portion between a closed position and an open position; and a bearing assembly disposed in the handle portion and comprising a first bearing race and a second bearing race, wherein each race comprises a ball housing in which a plurality of balls partially reside therein;

wherein the plurality of balls of each housing are positioned to contact an adjacent side surface of the tang thereby allowing the plurality of balls to roll along opposing sides of the tang as the tool element is pivoted from the open position to the closed position or the closed position to the open position;

wherein the first race and the second race each further include a flange extending radially outwardly from an inner end of the ball housing and a head portion extending axially from an outer end of the ball housing.

14. The folding tool of claim 13, wherein:

the first side panel liner includes an opening through which the ball housing of the first bearing race extends, and the second side panel liner includes an opening through which the ball housing of the second bearing race extends; and the flanges have a diameter greater than the openings in the first side panel liner and the second side panel liner.

15. The folding tool of claim 14, wherein the bearing assembly further comprises a first screw for securing the first race to the first side panel and a second screw for securing the second race to the second side panel.

16. A folding knife, comprising:

a handle portion including a first side panel with a first side panel inner surface, a second side panel with a second side panel inner surface, a first side panel liner, and a second side panel liner, wherein the first side panel liner is positioned adjacent to the first side panel inner surface, and the second side panel liner is positioned adjacent to the second side panel inner surface;

a blade pivotably connected to the handle portion and comprising a tang, a bottom surface including a sharpened edge, and an upper surface opposite the bottom surface, the blade being pivotable relative to the handle portion between a closed position and an open position wherein the sharpened edge is exposed for use;

a bearing assembly positioned between the first side panel and the second side panel, wherein the tang of the blade, the first side panel liner and the second side panel liner each include an opening for mounting the bearing assembly, and the bearing assembly comprising:

a first bearing race and a second bearing race, wherein each bearing race comprises a ball housing; and a first screw for securing the first race to the first side panel, and a second screw for securing the second race to the second side panel; and a plurality of balls residing partially within each ball housing, wherein the plurality of balls are positioned to contact an adjacent side surface of the tang thereby allowing the plurality of balls to roll along opposing sides of the tang as the blade is pivoted from the open position to the closed position or the closed position to the open position.

17. A folding tool, comprising:

a handle portion including a first side panel with a first side panel inner surface and a second side panel with a second side panel inner surface;

a tool element pivotably connected to the handle portion and comprising a tang, and the tool element being pivotable relative to the handle portion between a closed position and an open position;

a bearing assembly positioned between the first side panel and the second side panel, the bearing assembly comprising:

a first bearing race and a second bearing race, wherein each bearing race comprises a ball housing; and a first screw for securing the first race to the first side panel and a second screw for securing the second race to the second side panel; and a plurality of balls residing partially within each ball housing, wherein the plurality of balls are positioned to contact an adjacent side surface of the tang thereby allowing the plurality of balls to roll along opposing sides of the tang as the tool element is pivoted from the open position to the closed position or the closed position to the open position.

18. The folding tool of claim 17, further comprising:

a shaft fixedly secured to the ball housing of the first bearing race and extending through the tang whereupon the ball housing of the second bearing race is mounted.

19. The folding tool of claim 18, wherein:

the ball housing of the first bearing race and the shaft define a threaded bore; and the first screw and the second screw are tightened into opposite ends of the threaded bore.

20. The folding tool of claim 17, wherein the first screw extends into a threaded bore that extends through the ball housing of the first bearing race, and the second screw extends into a threaded bore that extends through the ball housing of the second bearing race.

21. The folding tool of claim 17, wherein the ball housing and the plurality of balls of the first bearing race are different sizes than the ball housing and the plurality of balls of the second bearing race.

* * * * *